US007651182B2

(12) United States Patent
Eveland et al.

(10) Patent No.: US 7,651,182 B2
(45) Date of Patent: Jan. 26, 2010

(54) ADJUSTABLE RETAINER ASSEMBLY FOR A REFRIGERATOR DOOR STORAGE UNIT

(75) Inventors: Michael J. Eveland, Cedar Rapids, IA (US); Jonathan J. Tiemeier, Cedar Rapids, IA (US)

(73) Assignee: Maytag Corporation, Benton Harbor, MI (US)

( * ) Notice: Subject to any disclaimer, the term of this patent is extended or adjusted under 35 U.S.C. 154(b) by 699 days.

(21) Appl. No.: 11/394,219

(22) Filed: Mar. 31, 2006

(65) Prior Publication Data

US 2007/0228908 A1 Oct. 4, 2007

(51) Int. Cl.
*A47B 96/04* (2006.01)

(52) U.S. Cl. ..... 312/405.1

(58) Field of Classification Search ..... 312/405.1, 312/401, 405, 408, 321.5, 116, 348.3; 211/88.01, 211/184, 90.01, 75, 88, 99, 100; 62/377; 248/311.2; 220/762, 763, 764
See application file for complete search history.

(56) References Cited

U.S. PATENT DOCUMENTS

| | | | | |
|---|---|---|---|---|
| 3,220,558 | A | 11/1965 | Olsson | |
| 3,837,477 | A * | 9/1974 | Boudreau | 206/376 |
| 3,851,765 | A | 12/1974 | Cox | |
| 3,893,739 | A | 7/1975 | Bernard | |
| 5,160,191 | A * | 11/1992 | Holland et al. | 312/405.1 |
| 5,217,193 | A * | 6/1993 | Drucker | 248/148 |
| 5,567,029 | A | 10/1996 | Haenisch et al. | |
| 6,039,424 | A | 3/2000 | Pink | |
| 6,186,608 | B1 | 2/2001 | Pink | |
| 6,220,684 | B1 | 4/2001 | Bent et al. | |
| 2005/0067928 | A1 * | 3/2005 | Berger et al. | 312/348.3 |

FOREIGN PATENT DOCUMENTS

| | | |
|---|---|---|
| DE | 4304502 | 8/1994 |
| EP | 611930 | 8/1994 |
| JP | 410122733 | 5/1998 |
| JP | 411118338 | 4/1999 |
| JP | 2000009378 | 1/2000 |
| JP | 2000009379 | 1/2000 |
| JP | 20000065466 | 3/2000 |

* cited by examiner

*Primary Examiner*—Janet M Wilkens
*Assistant Examiner*—Timothy M Ayres
(74) *Attorney, Agent, or Firm*—Kirk W. Goodwin; Diederiks & Whitelaw PLC

(57) ABSTRACT

A storage unit for a refrigerator door includes an adjustable retainer assembly that can be positioned to accommodate food containers having varying widths. The storage unit includes a bottom portion and opposing side portions that define a storage cavity. The retainer assembly is sized to be received by the storage cavity. More specifically, the retainer assembly includes a base member that includes a bottom portion and opposing side portions. Each of the opposing side portions is provided with an adjustment elements. The retainer assembly also includes a retainer bar that includes a retaining surface that extends to two opposing side members. Each of the opposing sided members includes a detent element that enables the retainer bar to interconnect with the base member. In this manner, each of the opposing side members can be independently adjusted relative to the base member in order to conform to food containers having varying widths.

11 Claims, 4 Drawing Sheets

ADJUSTABLE RETAINER ASSEMBLY FOR A REFRIGERATOR DOOR STORAGE UNIT

BACKGROUND OF THE INVENTION

1. Field of the Invention

The present invention pertains to the art of refrigerated appliances and, more particularly, to an adjustable retainer assembly for maintaining food containers of varying widths in a desired storage condition within a storage unit provided on a refrigerator door.

2. Discussion of the Prior Art

It is well known in the art of refrigerated appliances to provide structure on inner liners of fresh food and freezer doors to support shelf units for retaining various food containers. Typically, the shelf units are in the form of fixed or removable shelves or bins that are incorporated onto the door liner. The removable shelves can be arranged at various positions on the inner liner to provide spacing to accommodate food containers having varying heights. In addition, the food containers must be adequately retained so as to prevent unnecessary toppling when the refrigerator door is operated.

More specifically, without proper retention, food containers can topple over when the refrigerator door is opened and/or closed. That is, if too much opening/closing force is applied, a food container may become dislodged from the shelf, topple over, spill or even break when the refrigerator door is abruptly opened and/or closed. In an attempt to solve this problem, it has been proposed to attach additional retaining structure to the door liner or to the shelves themselves. Such retaining structures typically take the form of retaining bars that apply pressure to an upper portion of the food container. The retaining bars hold the container in place when the door is operated. U.S. Pat. No. 5,567,029 discloses various product retainer arrangements, each including a removable retainer element mounted to an inner liner of a refrigerator door. The retainer element is capable of being pivoted to accommodate a deep refrigerator door shelf in order to retain containers having a variety of heights. However, in addition to the need to accommodate various container heights, the width of the container must also be considered. In today's marketplace, there is simply no uniformity in the width of food containers currently available.

Containers having various widths are subject to the same forces and drawbacks associated with retaining containers having varying heights. Specifically, unless adequately restrained, the food containers can shift about the shelf, spill, topple over or break when the door is abruptly opened or closed. While retaining bars help protect taller containers from opening and closing forces, they are not effective in retaining shorter containers, particularly those of varying widths. That is, the retaining bar will only grip or retain the widest of the containers, while allowing the smaller sized containers to move about. In an attempt to solve this problem, the prior art contains examples of flexible retaining structure, such as bungee cords or netting, that can conform to the shape of articles on the shelves. While effective to some degree, flexible retaining structure typically requires two hands to operate. That is, one hand must deflect the retaining structure, while the other hand places the food container on the shelf. Given the inconvenience of operating the retaining structure, the structure may fall into disuse, or be removed so as to enable easier access to the storage unit.

Based on the above, it would be desirable to have an adjustable retainer assembly for refrigerator door shelves which can accommodate food containers of various widths. More specifically, there exits a need for an easily accessible, adjustable retaining assembly that can be incorporated into new refrigerators or retrofitted into existing refrigerator shelf units for use in effectively retaining a wide range of containers.

SUMMARY OF THE INVENTION

The present invention is directed to an adjustable retaining assembly that can be readily placed into a refrigerator door storage unit. The storage unit can be either fixedly or removably mounted to an inner liner of the refrigerator door. More specifically, the storage unit preferably includes a front wall, a bottom wall, a back wall and opposing side walls that collectively define a storage cavity. In accordance with a preferred form of the invention, the adjustable retainer assembly is sized so as to be received in the storage cavity to retain food containers of varying widths. The adjustable retainer assembly includes a base member having a bottom portion and opposing side portions. Arranged on each opposing side portion are a plurality of adjustment elements. In addition to the base member, the adjustable retainer assembly includes a retainer bar having a retaining surface that extends horizontally towards opposing side members. Preferably, each of the opposing side members includes a corresponding detent element that enables the retaining bar to interconnect with the base member to selectively retain containers of varying widths.

In accordance with a preferred form of the invention, the plurality of adjustment elements take the form of slots that are sized and shaped so as to receive a respective detent element. In this manner, the retainer bar can be selectively spaced from a rear portion of the base member. More specifically, this arrangement enables each of the opposing side members to be independently adjusted and spaced from the rear portion in order to accommodate food containers of varying widths.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
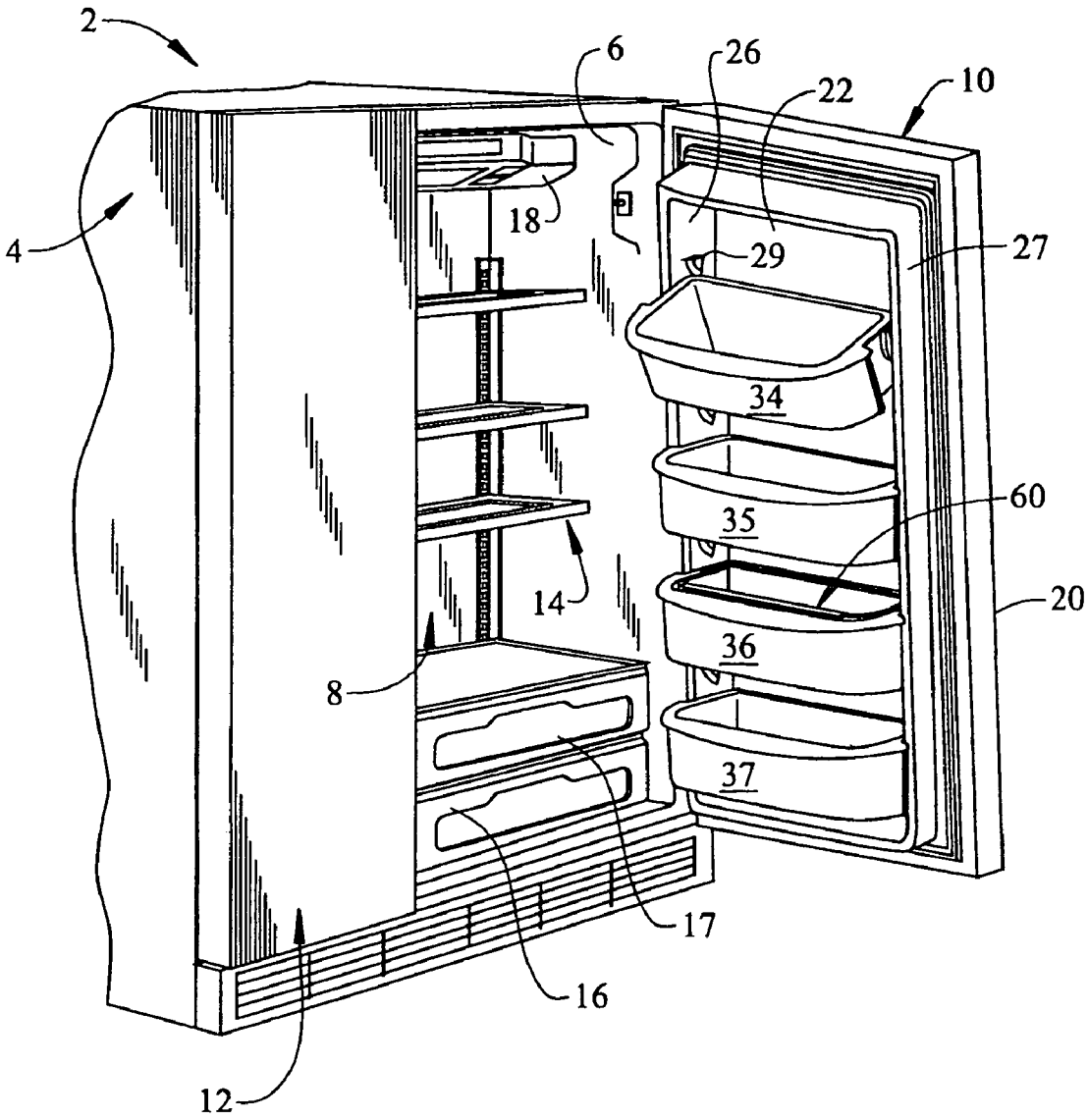
FIG. 1 is a partial, perspective view of a side-by-side refrigerator including an adjustable retainer assembly constructed in accordance with the present invention incorporated into one of a plurality of buckets shown arranged on an inner liner portion of a fresh food door of the refrigerator.

With initial reference to FIG. 1, a side-by-side refrigerator 2 is shown including a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to selectively access a freezer compartment (not shown). In the embodiment shown, fresh food compartment 8 is provided with a plurality of vertically spaced shelves, one of which is indicated at 14, along with multiple, slidably mounted bins 16 and 17. Also illustrated in FIG. 1 is a control housing 18 arranged at an upper portion of fresh food compartment 8.

In a manner known in the art, fresh food door 10 includes an outer shell 20 and an inner liner 22 that includes dike portions 26 and 27 integrally molded with a plurality of vertically spaced support members 29. In a manner also known in the art, refrigerator 2 is provided with a plurality of storage units 34-37, which could be constituted by buckets or shelves, arranged on inner liner 22 of fresh food door 10. As each storage unit 34-37 is shown identical, a detailed description of storage unit 36 will be presented with an understanding that the remaining storage units 34, 35 and 37 include corresponding structure.

Figure 2:
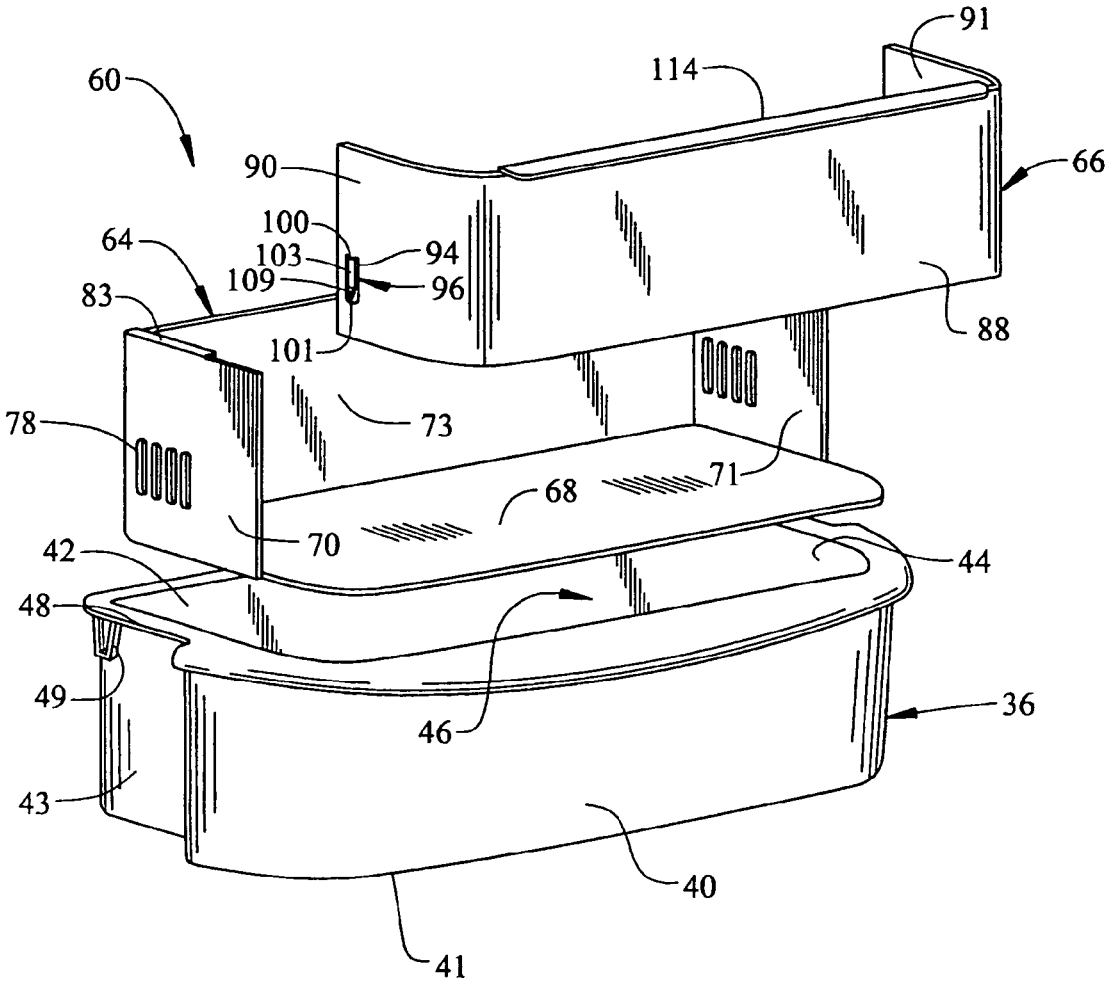
FIG. 2 is an enlarged exploded view of the bucket and adjustable retainer assembly of FIG. 1.

As best shown in FIG. 2, storage unit 36 includes a front wall 40, a bottom wall 41, a back wall 42 and opposing side walls 43, 44 that collectively define a storage cavity 46. In addition, storage unit 36 is provided with a peripheral lip 48 and a keeper element 49 that, together with a second, opposing keeper element (not shown) support storage unit 36 on inner liner 20 through support members 29. In general, the basic structure of refrigerator 2 described above is known in the art and presented only for the sake of completeness. However, at this point, it should be realized that refrigerator 2 can take on various forms known in the art without departing from the present invention as will be realized more fully below in discussing the specific aspects of the invention.

Figure 3:
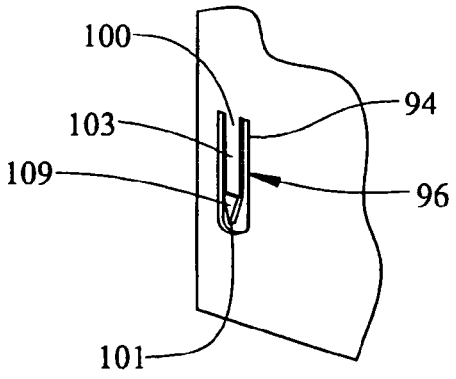
FIG. 3 is a partial, detail view of a detent element portion of the adjustable retainer assembly of FIG. 2.

The present invention is particularly directed to an adjustable retainer assembly 60 adapted to be selectively placed in one or more of the plurality of storage units 34-37. In accordance with a preferred form of the present invention, retainer assembly 60 includes a base member 64 and a retainer bar 66. As best shown in FIGS. 2 and 3, base member 64 includes a bottom portion 68, opposing side portions 70 and 71, and a rear portion 73. Preferably, each of base member 64 and retainer bar 66 are each formed or integrally molded from plastic. In any event, as will be detailed more fully below, bottom portion 68 includes an extended section (not separately labeled) that projects beyond opposing side portions 70, 71 and includes a rounded front edge (also not separately labeled). In further accordance with the preferred form shown, base member 64 is provided with a plurality of adjustment elements indicated generally at 78 arranged on each opposing side portion 70, 71. In the most preferred form of the invention, adjustment elements 78 constitute a plurality of slots, each having a generally rectangular shape. In addition, base member 64 is provided with a pair of flanges 83 and 84 (see FIGS. 2 and 4) that, as will be discussed more fully below, are adapted to retain retainer bar 66 in a vertical direction.

Figure 4:
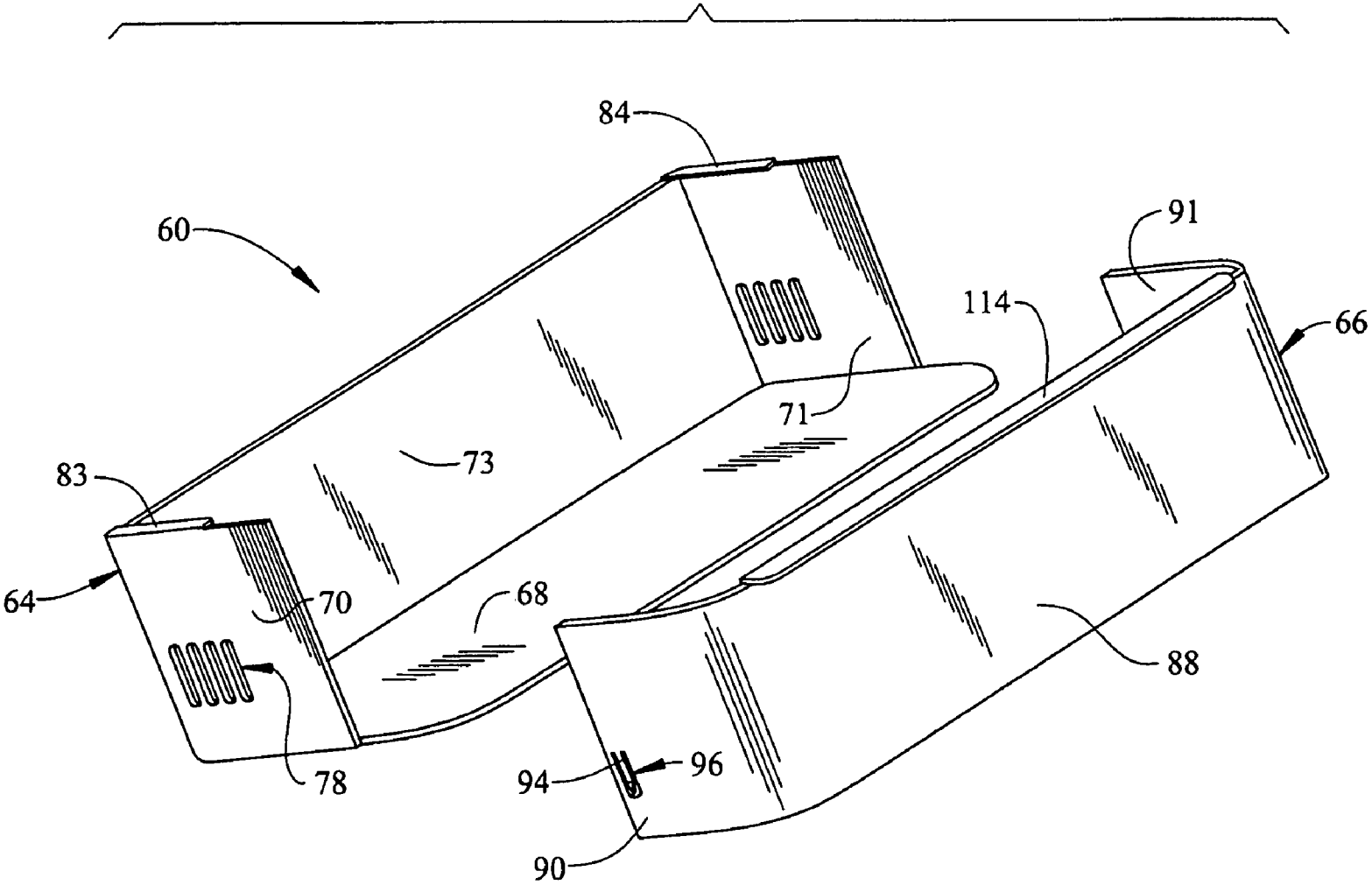
FIG. 4 is an exploded view of the adjustable retainer assembly of FIG. 2.

As further shown in FIGS. 2 and 4, retainer bar 66 includes a front retaining surface 88 that extends to a pair of opposing side members 90 and 91. In the preferred form of the invention, each opposing side member 90, 91 is provided with a corresponding opening 94 (also see FIG. 3) into which extends a respective detent element 96. Actually, detent element 96 is cantilevered from a respective opposing side member 90, 91 and projects into opening 94. Detent element 96 is adapted to engage with adjustment elements 78 to selectively position retainer bar 66 relative to base member 64. More specifically, detent element 96 includes a first end 100 that extends from an upper portion (not separately labeled) of opening 94 and leads to a second, cantilevered end 101 through a flexible intermediate segment 103. In accordance with the most preferred form of the invention, second cantilevered end 101 is provided with a tab element 109, which is preferably a substantially triangular shape, sized to nest into adjustment element 78. Finally, retainer bar 66 is provided with an upper flange or lip 114.

Figure 5:
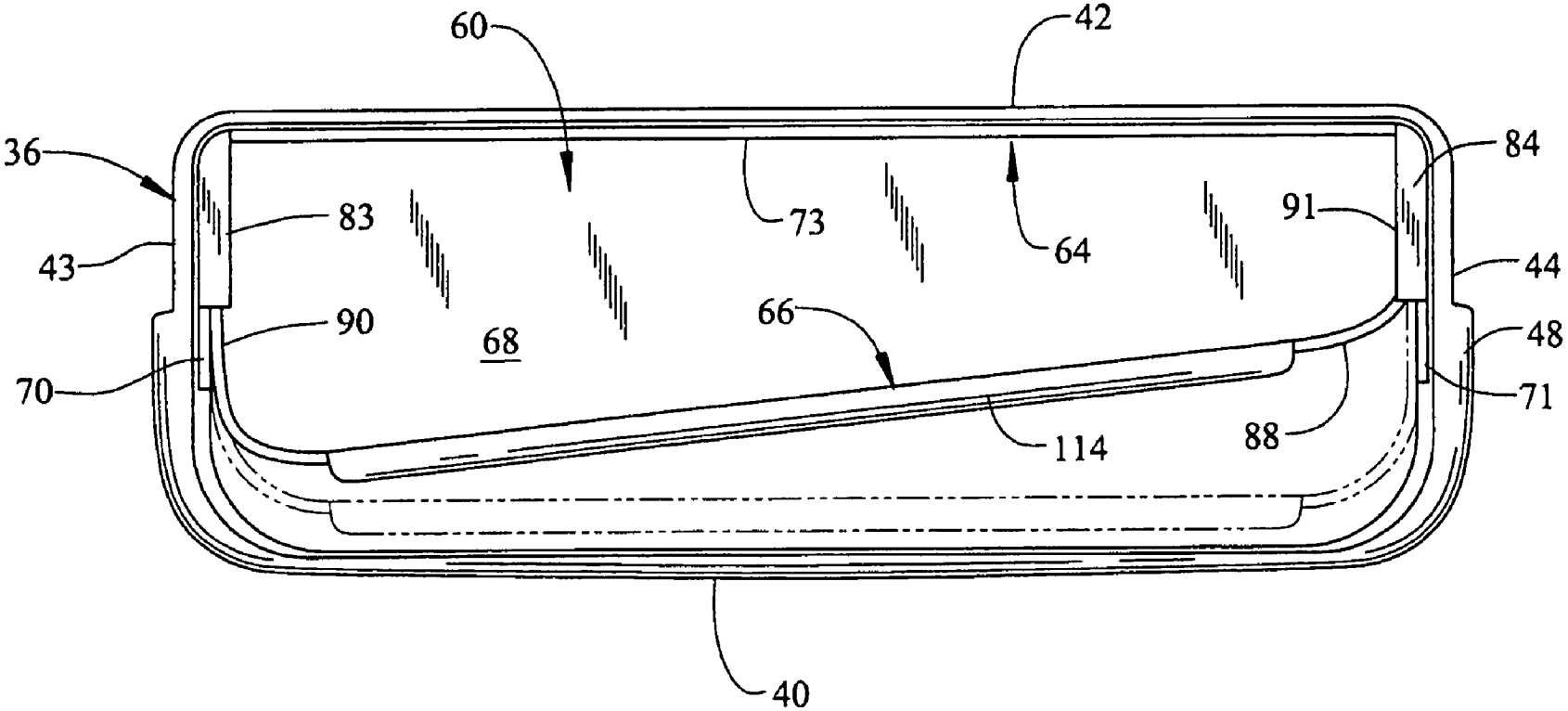
FIG. 5 is a top view of the adjustable retainer assembly shown in the bucket.

With particular reference to FIG. 5, retainer bar 66 can be selectively positioned such that retaining surface 88 extends substantially parallel to rear portion 73 atop the extended section of bottom portion 68 as shown in phantom or, alternatively, positioned so as to extend across storage unit 36 at various angles, one of which is shown in solid in this figure, by positioning each opposing tab elements 109 in engagement with a selected adjustment element 78. With this overall arrangement, retainer bar 88 can be positioned so as to accommodate food containers of varying widths that are supported within storage unit 36 so that, upon opening or closing of refrigerator door 10, food items are not caused to tumble forward out of storage cavity 46.

Although described with reference to a preferred embodiment of the present invention, it should be readily apparent to one of ordinary skill in the art that various changes and/or modifications can be made to the invention without departing from the spirit thereof. For instance, while adjustment elements 78 are shown as a plurality of slots and detent element 96 is shown as a cantilevered member and detent element 96 are shown as tab, various other types of interlocking configurations and geometries defining the adjustment element and detent element could be used so long as retainer bar 66 can be selectively re-positioned along each opposing side portion 90, 91. Also, while adjustable retainer assembly 60 is shown placed within a bucket type storage unit, adjustable retainer assembly 60 can be placed in other types of storage units including those not having an integral front wall, those including a front wall in the form of a narrow bar or those integrally formed in the door liner. That is, the adjustable retainer could cooperate with structure molded into dike portion of the door. Finally, it should be understood that, while shown in connection with storage units on a fresh food door, the adjustable retainer assembly could also be provided on a freezer door. In general, the invention is only intended to be limited to the scope of the following claims.

We claim:

1. A refrigerator comprising:

a cabinet;

a door pivotally mounted to the cabinet, said door including an outer panel and an inner liner;

a storage unit including at least a bottom wall, a back wall, a front wall and opposing side walls that collectively define a storage cavity, said storage unit being provided on the inner liner of the door; and an adjustable retainer assembly provided in the storage unit, said adjustable retainer assembly including a base member having at least a back portion adjacent the back wall of the storage unit and opposing side portions provided with a plurality of adjustment elements, and a retaining bar including a front retaining member and opposing side members extending from the front retaining member, said opposing side members of the retaining bar being interengaged with the plurality of adjustment elements to position the retaining bar at any one of a plurality of selective angles relative to the base member within the storage cavity in order to retain packages of varying sizes in the storage cavity.

2. The refrigerator according to claim 1, wherein each of said opposing side members including a detent element, said detent element interengaging with select ones of the plurality of adjustment elements to angle the retaining bar relative to the base member within the storage cavity.

3. The refrigerator according to claim 2, wherein the plurality of adjustment elements on the opposing side portions constitute slots.

4. The refrigerator according to claim 2, wherein each of the opposing side members includes an opening having top bottom and opposing side edges, said detent element including a first end and a second, cantilevered end, said first end being secured to the top edge and said cantilevered end being spaced from the bottom edge.

5. The refrigerator according to claim 4, wherein the second end of the detent element includes a tab element.

6. The refrigerator according to claim 5, wherein the tab element is substantially triangular.

7. The refrigerator according to claim 1, further comprising: first and second rib members, each of said first and second rib members being formed on a respective one of the opposing side portions of the base member, said first and second rib members being adapted to capture the retaining bar.

8. The refrigerator according to claim 1, wherein the base member includes a bottom portion, said bottom portion being connected to the back and opposing side portions.

9. The refrigerator according to claim 1, wherein the bottom portion of the base member includes a front edge section that extends beyond the opposing side portions.

10. The refrigerator according to claim 1, wherein each of the base member and the retaining bar is molded from plastic.

11. A method of retaining products in a storage cavity provided on the inner liner of a refrigerator door, the storage unit including at least a bottom wall, a back wall, a front wall and opposing side walls collectively defining a storage cavity, the method comprising:

placing a base member into the refrigerator door storage unit, said base member including at least a rear portion adjacent the back wall of the storage unit and opposing side portions including a plurality of adjustment elements;

positioning a retaining bar across the base member, said retainer bar having a front retaining member and opposing side members extending from the front retaining member; and interconnecting the opposing side members of the retaining bar with the plurality of adjustment elements while positioning the retaining bar at any one of a plurality of selective angles relative to the base member within the storage cavity in order to retain packages of varying sizes in the storage cavity.

* * * * *

UNITED STATES PATENT AND TRADEMARK OFFICE

CERTIFICATE OF CORRECTION

PATENT NO. : 7,651,182 B2
APPLICATION NO. : 11/394219
DATED : January 26, 2010
INVENTOR(S) : Michael J. Eveland It is certified that error appears in the above-identified patent and that said Letters Patent is hereby corrected as shown below:

On the Title Page:

The first and sole Notice should read --

Subject to any disclaimer, the term of this patent is extended or adjusted under 35 U.S.C. 154(b) by 971 days.

Signed and Sealed this

Twenty-eighth Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,651,182 B2
APPLICATION NO. : 11/394219
DATED : January 26, 2010
INVENTOR(S) : Eveland et al.

It is certified that error appears in the above-identified patent and that said Letters Patent is hereby corrected as shown below:

Claim 11, line 1, which is found at column 6, line 3 of the patent, the word "cavity" should be changed to --unit--.

Signed and Sealed this
Seventh Day of June, 2011

David J. Kappos

David J. Kappos
*Director of the United States Patent and Trademark Office*